US008286421B2

(12) United States Patent
Dickinson et al.

(10) Patent No.: US 8,286,421 B2
(45) Date of Patent: Oct. 16, 2012

(54) EXHAUST DIFFUSER FOR A TRUCK

(75) Inventors: Hugh Thomas Dickinson, Greensboro, NC (US); Clinton Lane Lafferty, Jackson, TN (US); Rayvonn Donnell Core, Mebane, NC (US); William Robert Miller, Shepherdstown, WV (US)

(73) Assignee: Volvo Group North America, LLC, Greensboro, NC (US)

( * ) Notice: Subject to any disclaimer, the term of this patent is extended or adjusted under 35 U.S.C. 154(b) by 684 days.

(21) Appl. No.: 12/310,778

(22) PCT Filed: Dec. 21, 2006

(86) PCT No.: PCT/US2006/048956

§ 371 (c)(1),
(2), (4) Date: Sep. 23, 2009

(87) PCT Pub. No.: WO2008/030259

PCT Pub. Date: Mar. 13, 2008

(65) Prior Publication Data

US 2010/0043412 A1 Feb. 25, 2010

Related U.S. Application Data

(60) Provisional application No. 60/842,842, filed on Sep. 7, 2006.

(51) Int. Cl.
*F01N 3/05* (2006.01)

(52) U.S. Cl. ..... 60/317; 60/320

(58) Field of Classification Search ..... 60/317, 60/319, 324, 320; 181/247–249, 255, 230
See application file for complete search history.

(56) References Cited

U.S. PATENT DOCUMENTS

| | | | | |
|---|---|---|---|---|
| 3,797,241 | A | 3/1974 | Kern | |
| 3,817,030 | A | 6/1974 | Renius | |
| 4,147,230 | A | 4/1979 | Ormond | |
| 4,348,862 | A | 9/1982 | Fujikawa | |
| 5,058,704 | A | 10/1991 | Yu | |
| 5,269,132 | A | 12/1993 | Loucks | |
| 5,371,331 | A | 12/1994 | Wall | |
| 2001/0017031 | A1 | 8/2001 | Sekiya | |
| 2003/0079467 | A1 * | 5/2003 | Liu et al. | 60/286 |
| 2004/0206073 | A1 | 10/2004 | Yamamoto | |
| 2005/0005594 | A1 | 1/2005 | Brun | |
| 2005/0005601 | A1 * | 1/2005 | Piercey, III | 60/506 |
| 2005/0205355 | A1 | 9/2005 | Lin | |

FOREIGN PATENT DOCUMENTS

| | | | |
|---|---|---|---|
| DE | 4322436 | A1 | 1/1995 |
| JP | 60134814 | U | 2/1984 |
| JP | 60175718 | A | 9/1985 |
| JP | 2002317631 | A | 10/2002 |

OTHER PUBLICATIONS

Statement of relevance for JP S60-134814. Supplementary European Search Report dated Sep. 29, 2010 for corresponding application No. EP 06845987.

* cited by examiner

*Primary Examiner* — Binh Q Tran
*Assistant Examiner* — Jonathan Matthias
(74) *Attorney, Agent, or Firm* — Martin Farrell; Michael Pruden

(57) ABSTRACT

An exhaust diluting and diffusing apparatus includes a pipe mountable on a exhaust stack pipe, and having a flared skirt inlet to define an annular inlet, a mixing section adjacent the inlet, and an exhaust section formed as a pipe section with a multiplicity of holes. The apparatus pipe has a diameter greater than the diameter of the exhaust stack on which it is mounted.

12 Claims, 4 Drawing Sheets

EXHAUST DIFFUSER FOR A TRUCK

This application claims the benefit of U.S. Provisional Patent Application No. 60/842,842, filed Sep. 7, 2006.

The invention relates to devices mounted on truck exhaust systems to dilute and diffuse the exhaust gas as it is released from the truck

BACKGROUND

Exhaust treatment devices in trucks require maintenance procedures that can create situations where exhaust temperatures are much higher than during normal use of the vehicle. For example, diesel particulate filters, which trap soot and other particulate matter in the exhaust stream, require a regeneration process to burn off the collected matter. The process requires that the temperature of the exhaust entering the diesel particulate filter be in excess of 600° C. Normal operating exhaust temperature is about 425° C. for a diesel engine in a truck.

Exhausting the higher temperature stream to atmosphere poses difficulties. A truck typically has an exhaust stack pipe rising from the chassis adjacent to the truck cab. High temperature exhaust can produce a hot spot on the truck cab or trailer, or direct hot gases to a building (such as at a loading dock) or an overhanging tree.

What is needed is a device to reduce the exhaust temperature of an engine during regeneration procedure. Preferably, the device would not drastically affect the exhaust backpressure.

SUMMARY OF THE INVENTION

According to the invention, a device is mounted on an exhaust outlet pipe of a diesel particulate filter or an exhaust stack pipe and includes a pipe having a diameter greater than the diameter of the exhaust conduit to avoid backpressure in the gas flow. The device includes at an inlet end a diluter to create a venturi effect to draw ambient air into the exhaust gas flow to dilute the exhaust gas. A perforated pipe section serves as a diffuser to exhaust the diluted exhaust gas to atmosphere. The diluter/diffuser is mounted downstream of the DPF and catalyst in the exhaust system to handle high temperature exhaust gases.

The diffuser device is mounted on the stack pipe and includes a diluter body that flares outward and extends over the DPF exhaust conduit or stack pipe. The flared body defines an annular cone space for an inlet to the device, which draws in ambient air to mix with the exhaust gases in a mixing section. Downstream of the mixing section is a diffuser section, which is preferably a section of perforated pipe. The exhaust gases are dissipated to the atmosphere through the perforated outlet pipe. The axial end of the outlet pipe is closed, which forces all exhaust gas to exit through the perforations. The total open area of the perforations is greater than the open area at the axial end of a standard five inch exhaust pipe, which also helps eliminate added back pressure. Preferably, the perforations in the pipe provide an exhaust area approximately 2.5 times the cross sectional area of a five inch exhaust pipe, which helps dissipate and diffuse the exhaust gases to atmosphere.

Analysis indicates that the ambient air drawn in by the diffuser will reduce gas temperature approximately 100 deg. C. at the outlet surface of the exhaust pipe.

Analysis has predicted that at 6" from the pipe surface, the exhausted gas will be at a lower temperature during regeneration than exhaust gases at 6" from a conventional exhaust pipe during normal operation of a truck not having a diffuser of the invention.

According to another aspect of the invention, the hole pattern of the diffuser part can be a uniform pattern of holes, that is, holes of equal size spaced uniformly over the diffuser wall.

Alternatively, the hole pattern can be non-uniformly formed, with a greater density of open area at the upstream end of the diffuser and a lesser density of open area at the downstream end. Such an arrangement helps generate a uniform flow exiting the diffuser along the length of the diffuser. According to one embodiment, holes of larger diameter are positioned at the upstream end and holes of smaller diameter positioned at the downstream end. The holes may be sized to decrease by a factor, according to one embodiment, ½ the open area, for each step change. Conveniently, several rows of holes of each size may be provided.

Another alternative for an non-uniform hole pattern is a pattern of same sized holes arranged for a greater open area at the upstream end and a lower open area at the downstream end. This may be achieved by spacing rows of the holes closer adjacent the mixer section and farther apart at the cap end. According to one embodiment, the holes are arranged in rows that are spaced at 1 hole diameter between the first two rows, 1.5 hole diameters between the second and third rows, 2 hole diameters between the third and forth rows, and so on.

To protect the cab from hot exhaust gas, the hole pattern of the diffuser may be positioned on a radially outwardly facing surface of the diffuser pipe section less than the full 360 degree surface. The hole pattern may be on a 180 degree radially outward portion or a 90 degree portion as advantageous to protecting the cab while providing sufficient open area for exhaust.

Another embodiment of the invention includes a perforated diffuser section having a perforated heat shield disposed about the diffuser section. The heat shield or secondary diffuser may be in the form of a cylindrical body being open at the bottom, upstream end, and having a cap at the downstream end. The cylindrical body is disposed over the diffuser section so that ends of the cylindrical body are closed or sealed, forcing exhaust to exit through the perforations. Hole patterns for the heat shield may be uniform or non-uniform. The heat shield is spaced from the diffuser a sufficient distance so that the temperature at the heat shield is not likely to ignite substances that may contact the shield.

According to another embodiment of the invention, the diffuser section may extend horizontally and laterally across and above the back of the cab. According to another embodiment for a vocation truck, the diffuser section extends horizontally and longitudinally along a frame of the truck. The apparatus includes an extension pipe positioned that connects the inlet of the apparatus with the diffuser section.

BRIEF DESCRIPTION OF THE DRAWINGS

The invention will be better understood by reference to the following detailed description read in conjunction with the appended drawings, in which.

DETAILED DESCRIPTION

The invention relates to devices that are mounted on the end of a truck exhaust system at the point where exhaust gas is released to the surrounding air. In particular, the invention is an apparatus mounted on an exhaust downstream of a diesel particulate filter to diffuse the hot gases over a wide area. According to another aspect of the invention, structure is provided to dilute exhaust gases with ambient air and diffuse the diluted exhaust gas over a wider area than a typical exhaust stack pipe to prevent hot spots and dissipate heat more quickly.

Figure 1:
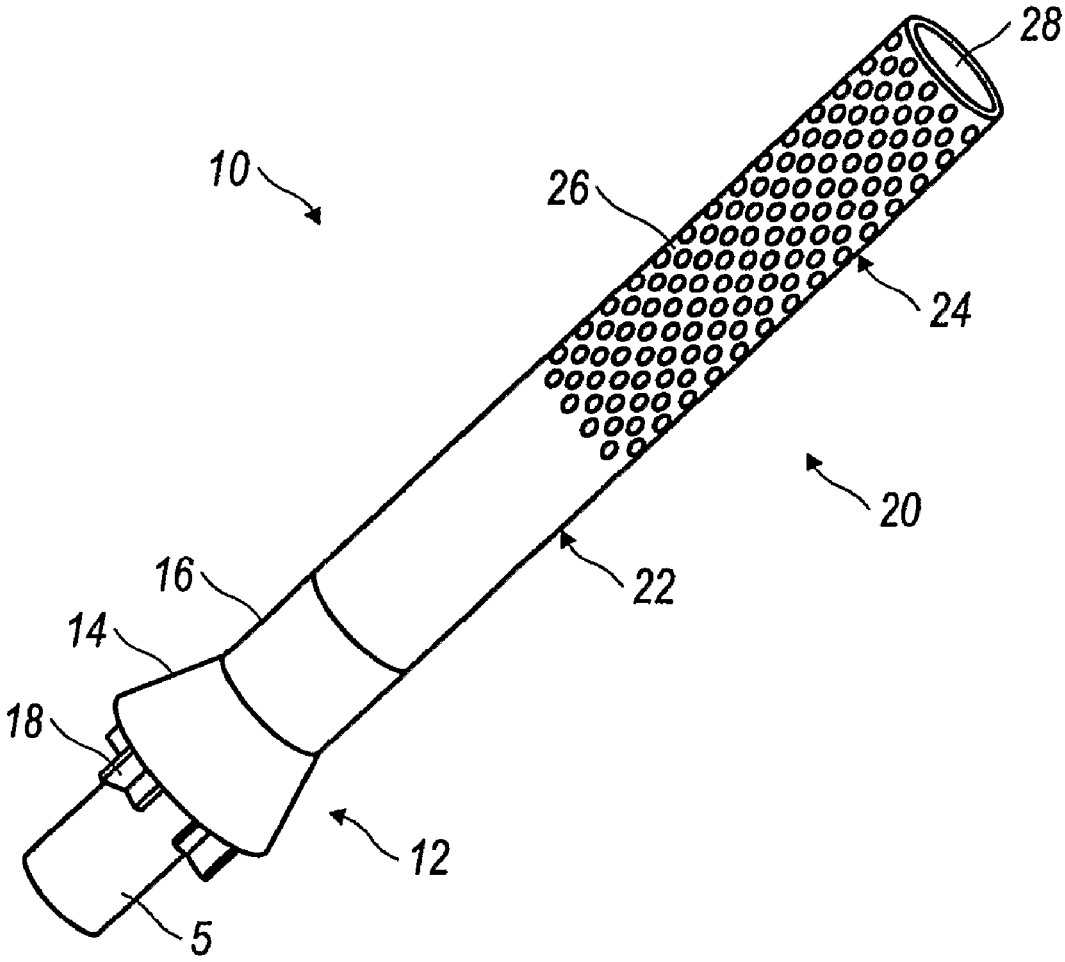
FIG. 1 illustrates an embodiment of an exhaust stack dilution and diffusion element.

FIG. 1 shows an embodiment of a combined dilution and diffusing device. The diffuser/diluter 10 of FIG. 1 is mountable on a standard 5 inch exhaust stack pipe 5. The apparatus includes a diluter section, here formed as a venturi element 12 having flared skirt 14 leading to a straight tube 16. Standoffs 18 mount the venturi element 12 to the stack pipe 5 in a co-axial disposition. The tube 16 is wider than the stack pipe 5, which creates an annular inlet opening into the tube. Gas flowing from the stack pipe 5 into the tube 16 creates a low pressure at the inlet that draws ambient air into the tube 16 to mix with the exhaust flow. The tube 16 connects to an outlet pipe 20. The outlet pipe 20 includes a mixing zone 22 having a closed wall and an outlet zone 24 having a multiplicity of outlet apertures or holes 26. An axial end 28 of the outlet pipe 20 is capped or closed. The diluter and diffuser devices are formed of heat resistant material, which may be stainless steel to avoid corrosion.

Exhaust gas flowing from the stack pipe 5 and ambient air drawn in by the venturi element 12 mix in the mixing zone 14 of the outlet pipe 20. The mixed exhaust and air flow to the outlet zone part 24, and are exhausted through the outlet holes 26. The outlet holes 26 define a cumulative open area much larger than the outlet of a standard five inch exhaust stack pipe (about 15.7 square inches), which diffuses the mixed exhaust gases over a broader area. Preferably, the outlet holes 26 present a cumulative area at least about 2.5 times the pipe outlet cross section or at least about 39 square inches for a 5 inch pipe. This leads to improved heat dissipation and the avoidance of hot spots. The holes may be positioned on an angular section of the diffuser section outwardly facing relative to the truck cab so as not to exhaust hot gas directly on the cab or truck body. The angular section may be determined as required by the architecture of the truck body and cab, and may be 180 degrees, for example.

The outlet holes 26 are shown in FIG. 1 as having uniform size and being arrayed in an evenly spaced pattern. Alternatively, the outlet holes can be arranged to provide a relatively greater open area adjacent the mixer section 22 and a relatively smaller open area adjacent the end cap 28. This arrangement provides a widely dispersed exhaust flow that is substantially uniformly distributed over the length of the diffuser. This is believed to be related to the flow characteristics of the exhaust gas, where the end cap 28 causes an abrupt decrease in flow velocity, which would tend to force a higher portion of the gas outward at that end of the diffuser. By having less open area adjacent the cap 28, the exiting flow is more evenly distributed over the length.

Figure 2:
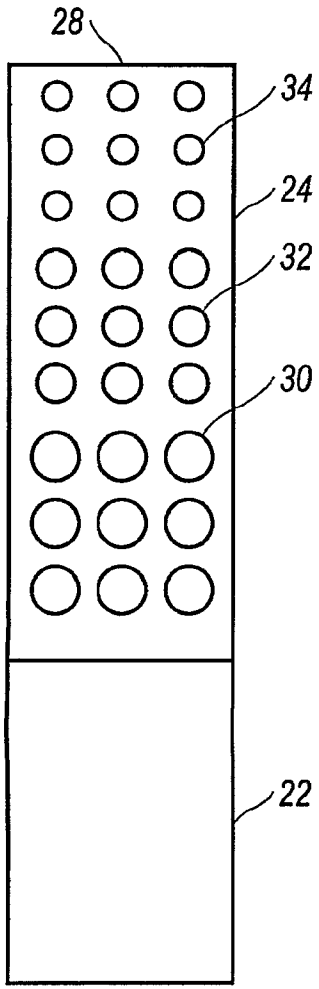
FIG. 2 illustrates a diffuser element in accordance with the invention having a pattern of unequally sized holes.

As illustrated in FIG. 2 in sectional view, the outlet holes can be formed with non-uniform size and arranged with larger diameter holes near the mixing section 22 and smaller diameter holes near the end cap 28. In the embodiment of FIG. 2, there are nine rows of holes, with three rows each of larger holes 30, medium 32 and smallest 34 holes in order of descending size. The holes may decrease in area, for example, decreasing by ½ the hole area at each step.

Figure 3:
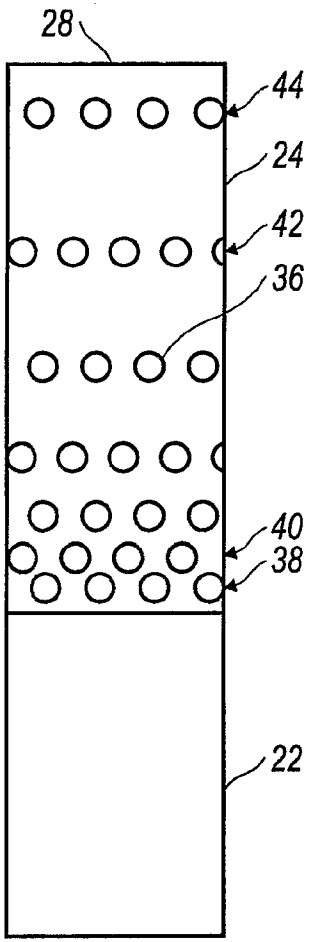
FIG. 3 illustrates a diffuser in accordance with the invention having a pattern of equally sized holes arranged with decreasing open area density.

Illustrated in FIG. 3 is an alternative arrangement, in which holes 36 of equal diameter are arranged in rows with spacing between rows increasing from the closest rows 38, 40 adjacent the mixing section 22 and the furthest spaced rows 42, 44 at the cap end. In this illustrated embodiment, the row spacing is equivalent to one hole diameter at the closest spaced rows 38, 40, and increases an additional ½ hole diameter for each successive row. The holes are positioned from row to row in a staggered relationship so that the holes of adjacent rows are not in axial alignment.

In general, smaller holes closely spaced will disperse exhaust gas to a larger ambient volume than will larger holes or less closely spaced holes. Those skilled in the art will understand that the particular hole arrangement must take into consideration the structural integrity of the diffuser and the ability to manufacture a diffuser tube with a desired hole arrangement.

Figure 4:
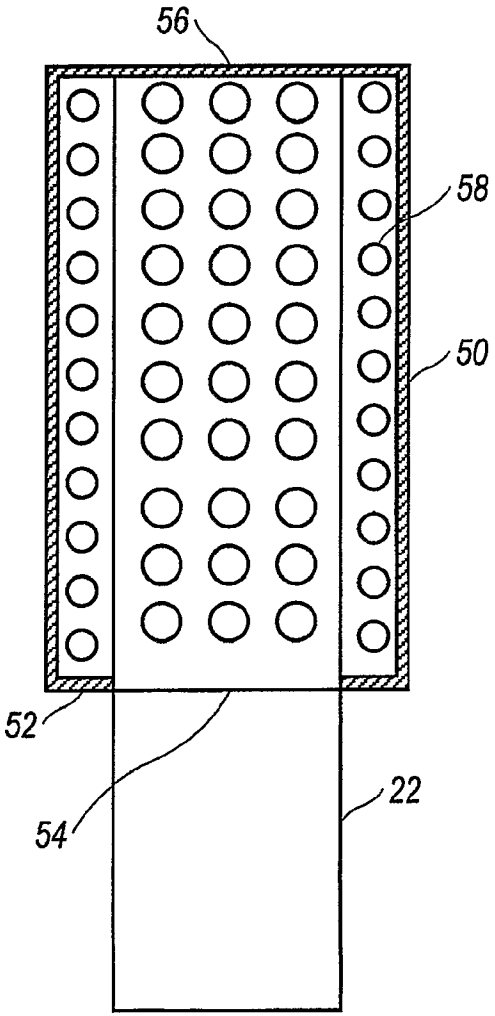
FIG. 4 shows a section view of a diffuser with a secondary diffuser.

According to another aspect of the invention, a secondary diffuser is provided over the diffuser section 24 to serve as a heat shield. As shown in section view in FIG. 4, the secondary diffuser 50 is a perforated cylindrical element that is disposed over and radially spaced from the diffuser 24. In particular for a vertically oriented diffuser, a flange 52 is formed at an open end 54 of the secondary diffuser 50 to fit snugly around the diffuser 24 to seal the bottom end of the secondary diffuser to prevent exhaust gas from exiting downward. An opposite, downstream end 56 is closed. The closed end 56 of the secondary diffuser rests on the cap 28 of the diffuser section 24. The holes 58 of the secondary diffuser 50 are shown as equal in size and regularly spaced. Alternatively, these holes may take different arrangement as in the main diffuser 24. The secondary diffuser may also be formed as a cylindrical section rather than a full cylinder. In the cases where the diffuser hole pattern is disposed on an outwardly facing angular section of the pipe, a secondary diffuser of at least the same angular section is suitable.

Figure 5:
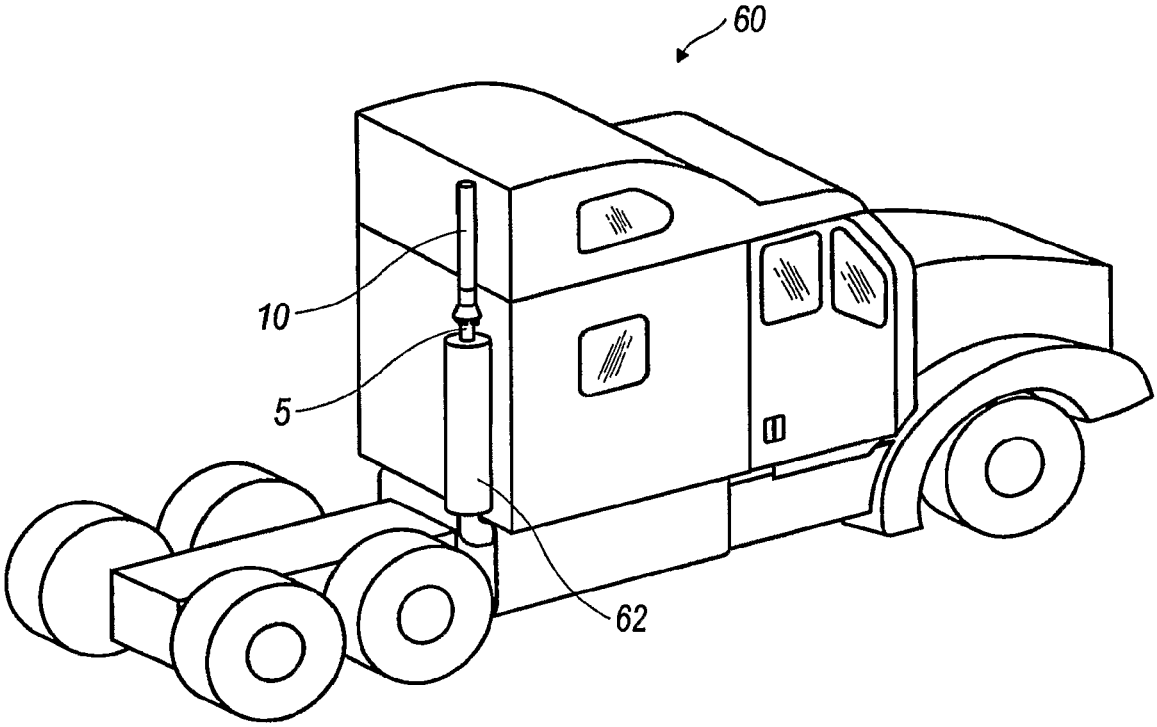
FIG. 5 shows an element according to FIG. 1 mounted on a truck cab exhaust.

FIG. 5 shows a diffuser/diluter device as described in connection with FIG. 1 mounted on a truck cab 60. A diesel particulate filter 62 is shown below and upstream of the diffuser/diluter device 10. A standard exhaust pipe 5 exits the diesel particulate filter 62 and leads to the diffuser/diluter device 10. Analysis of the heat flow pattern indicates that exhaust during regeneration exiting the device 10 will be at normal operation temperatures (non-regeneration exhaust) about six inches from the outlet pipe surface.

Figure 6:
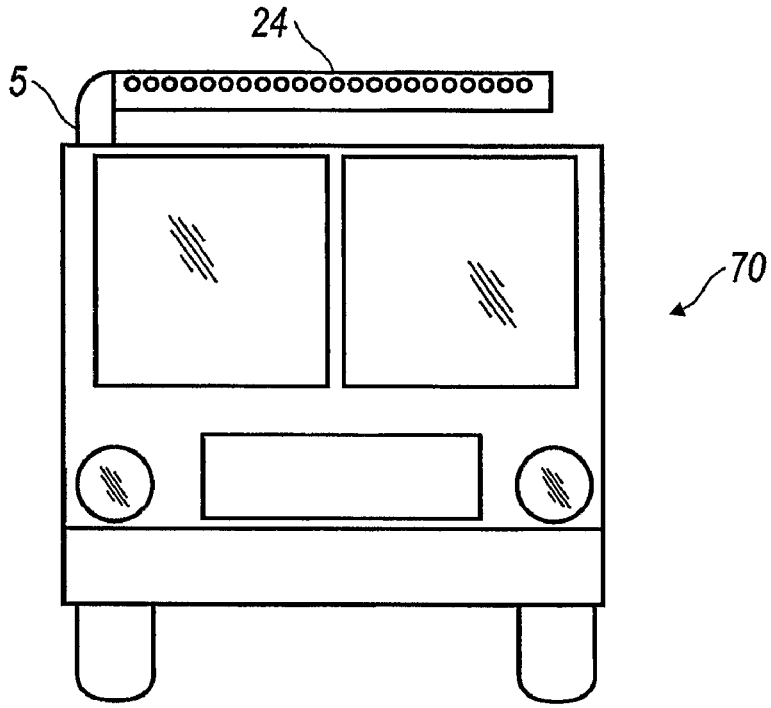
FIG. 6 shows a diffuser apparatus of an alternative embodiment mounted on a truck cab exhaust; and, FIG. 7 shows a diffuser element of another alternative embodiment mounted on a truck.

The truck 60 in FIG. 5 is representative of a long haul or highway truck. Other mounting arrangements may be more advantageous for different truck architectures. FIG. 6 illustrates an arrangement suitable for a vocational cab-forward truck 70, shown in front view, in which the diffuser section 24 is oriented substantially perpendicular to the exhaust pipe 5 and extends laterally above the truck cab. This arrangement provides a longer diffuser 24 and positions the diffuser above and away from operators and workers, which may be a better arrangement for a delivery truck, concrete mixer truck, or dump truck, for example.

Figure 7:
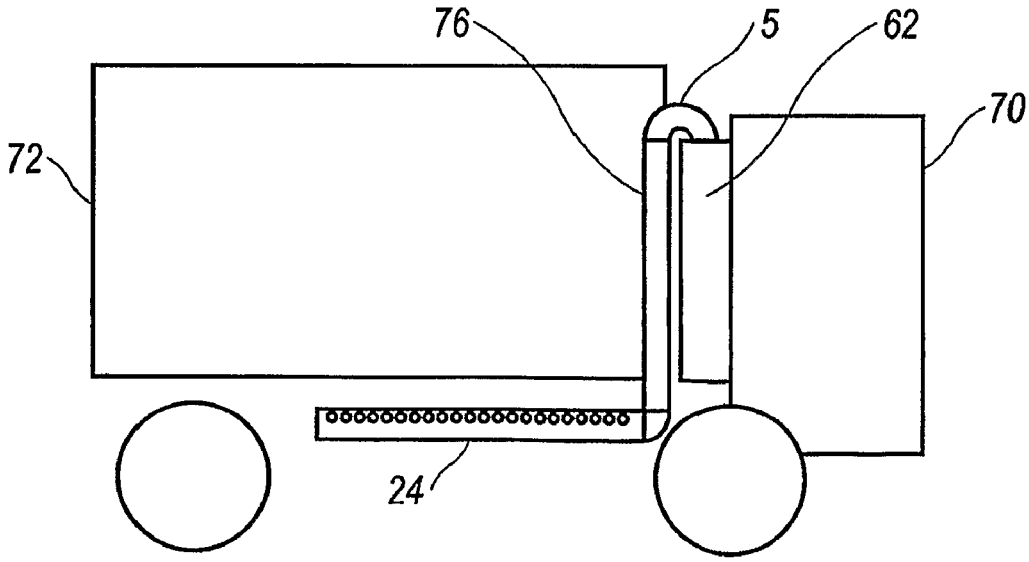

Another mounting arrangement is shown in FIG. 7, which illustrates the diffuser section 24 substantially perpendicular to the exhaust pipe 5, but positioned longitudinally along the truck frame and below the truck body 72. An extension pipe 76 carries the exhaust gas from the exhaust pipe 5 to the diffuser section 24. The arrangement of FIG. 7 is advantageous where an overhead exhaust presents difficulties, such as where the truck body may interfere with the exhaust, or where overhanging structure or trees are common where the truck operates.

The invention has been described in terms of preferred embodiments and structure; however those skilled in the art will understand that substitutions and variations may be made without departing from the scope of the invention as defined in the appended claims.

What is claimed is:

1. An apparatus for an engine exhaust, comprising:

a conduit adapted to be mounted on an exhaust gas pipe, the conduit having a solid walled inlet end section, a solid walled middle section, and a perforated walled outlet end section;

a cap mounted to and closing an axial end of the outlet end section of the conduit; and, a diluter mounted at the inlet end of the conduit to draw ambient air into an exhaust gas stream flowing into the conduit at the inlet end section of the conduit;

wherein, the solid walled middle section provides a mixer section between the inlet end section and the perforated walled outlet end section to allow ambient air drawn in by the diluter to mix with exhaust gas in the mixer section and wherein the perforated walled outlet end section provides a diffuser to exhaust the mixed ambient air and exhaust gas radially outward of the conduit.

2. The apparatus of claim 1, wherein the conduit is selected to have a diameter larger than a diameter of the exhaust pipe on which the apparatus is mounted so that there is provided an annular gap between an inner diameter of the conduit and an outer diameter of the exhaust pipe.

3. The apparatus of claim 1, wherein the diluter comprises a cone shaped skirt mounted on the inlet end of the conduit.

4. The apparatus of claim 1, wherein the perforations are uniformly sized.

5. The apparatus of claim 1, wherein the perforations define an open area greater than an open area of an exhaust pipe on which the apparatus is mounted.

6. The apparatus of claim 1, wherein the perforations are uniformly distributed on the outlet end of the pipe.

7. The apparatus of claim 1, wherein the perforations are non-uniformly sized and distributed with larger sized perforations near the mixer section.

8. The apparatus of claim 1, wherein the perforations are distributed to provide a relatively greater open area adjacent the mixer section and a relatively smaller open area adjacent the cap.

9. The apparatus of claim 8, wherein the perforations are arranged in rows and wherein the spacing between rows increases between successive rows from the mixer section to the cap end.

10. The apparatus of claim 1, further comprising a secondary diffuser disposed over and radially spaced about the diffuser.

11. The apparatus of claim 10, wherein the secondary diffuser is perforated with a multiplicity of holes.

12. The apparatus of claim 1, wherein the diffuser is oriented substantially perpendicular to the mixer section.

* * * * *